US006216687B1

(12) United States Patent
Campbell et al.

(10) Patent No.: US 6,216,687 B1
(45) **Date of Patent: *Apr. 17, 2001**

(54) UNVENTED HEATING APPLIANCE HAVING SYSTEM FOR REDUCING UNDESIRABLE COMBUSTION PRODUCTS

(75) Inventors: Larry E. Campbell, Knoxville, TN (US); Sydney R. Barkhouse, Etobicoke; Heinz H. Rieger, Toronto, both of (CA)

(73) Assignee: The Majestic Products Company, Huntington, IN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/821,851

(22) Filed: Mar. 21, 1997

Related U.S. Application Data

(60) Provisional application No. 60/013,967, filed on Mar. 22, 1996.

(51) Int. Cl.[7] ..... F24C 5/00

(52) U.S. Cl. ..... 126/512; 126/92 R; 126/92 B; 431/125

(58) Field of Search ..... 126/512, 58, 85 R, 126/90 R, 86, 92 R, 92 B; 422/180; 431/125, 126

(56) References Cited

U.S. PATENT DOCUMENTS

| | | | | |
|---|---|---|---|---|
| Re. 33,077 | | 10/1989 | Van Dewoestine . | |
| 1,621,135 | | 3/1927 | Sala . | |
| 1,703,459 | | 2/1929 | Sala . | |
| 1,726,000 | | 8/1929 | Sala . | |
| 1,884,746 | * | 10/1932 | Kline et al. | 126/299 R |
| 3,336,914 | * | 8/1967 | Ruhl | 126/90 |
| 4,194,490 | | 3/1980 | Crnkovic | 126/141 |
| 4,479,921 | * | 10/1984 | Allaire et al. | 422/180 |
| 4,553,527 | * | 11/1985 | Albertsen | 126/58 |

(List continued on next page.)

FOREIGN PATENT DOCUMENTS

| | | |
|---|---|---|
| 610285 | 2/1935 | (DE) . |
| 428393 | 5/1935 | (GB) . |
| 571924 | 2/1946 | (GB) . |
| 661919 | 11/1951 | (GB) . |
| 2 087 542 | 5/1982 | (GB) . |
| 2 203 532 A | 10/1988 | (GB) . |
| 2 216 252 | 10/1989 | (GB) . |
| 2 261 942 | 6/1993 | (GB) . |

OTHER PUBLICATIONS

Pure Heat Catalytic Gas Fireplace, Purely The World's Most Perfect Fireplace, No Date.

Catalytic Woodstoves A Great Heating Value, Corning Environmental Products Division, No Date.

*Primary Examiner*—James C. Yeung
(74) *Attorney, Agent, or Firm*—Baker & Daniels

(57) ABSTRACT

A gas-fueled heating appliance having a system for reducing the amount of undesirable combustion products released to the site in which the appliance is installed. The appliance includes a firebox partially surrounded by a heat exchanger. Ambient air is drawn into the heat exchanger below the firebox and a portion of the ambient air enters the firebox to assist in combustion, and the remaining portion travels through the heat exchanger to be heated by convection before being combined with combustion gases exiting through the top of the firebox. The heat exchanger creates a low pressure area relative to the firebox which induces a draft from the firebox into the heat exchanger and ultimately to the ambient environment through an exit provided above the firebox. A carbon monoxide catalyst element is provided in the exit passageway from the firebox to the heat exchanger to oxidize carbon monoxide into carbon dioxide and filter away airborne particulates which would otherwise be released to the ambient air.

35 Claims, 6 Drawing Sheets

U.S. PATENT DOCUMENTS

| | | | | |
|---|---|---|---|---|
| 4,580,546 | * | 4/1986 | Barnett | 126/58 |
| 4,688,548 | | 8/1987 | Stoughton | 126/298 |
| 4,690,126 | | 9/1987 | Jencks . | |
| 4,691,686 | | 9/1987 | Alvarez | 126/77 |
| 4,793,322 | * | 12/1988 | Shimek et al. | 126/85 B |
| 4,827,852 | | 5/1989 | Piontkowski . | |
| 4,844,051 | * | 7/1989 | Horkey | 126/58 |
| 4,919,120 | | 4/1990 | Horikoshi et al. | 126/93 |
| 5,054,468 | | 10/1991 | Moon et al. . | |
| 5,070,694 | * | 12/1991 | Whittenberger | 422/180 |
| 5,081,981 | | 1/1992 | Beal | 126/92 R |
| 5,094,074 | * | 3/1992 | Nishizawa et al. | 60/300 |
| 5,127,392 | | 7/1992 | Mizuno et al. | 126/92 R |
| 5,139,011 | | 8/1992 | Moon . | |
| 5,144,941 | | 9/1992 | Saito . | |
| 5,320,086 | | 6/1994 | Beal . | |
| 5,678,534 | * | 10/1997 | Fleming | 126/92 R |
| 5,960,789 | * | 10/1999 | Fleming | 126/512 |

* cited by examiner

UNVENTED HEATING APPLIANCE HAVING SYSTEM FOR REDUCING UNDESIRABLE COMBUSTION PRODUCTS

CROSS-REFERENCE TO RELATED APPLICATION

This application claims the benefit under Title 35, U.S.C. §119(e) of U.S. Provisional Patent Application Ser. No. 60/013,967, entitled UNVENTED GAS FIREPLACE HAVING SYSTEM FOR REDUCING UNDESIRABLE COMBUSTION PRODUCTS, filed on Mar. 22, 1996.

BACKGROUND OF THE INVENTION

1. Field of the Invention

This invention generally relates to heating appliances and, more particularly, relates to gas-fueled heating appliances, both ventless, which vent combustion gases directly into the room in which the appliance is installed and vented, which vent combustion gases to atmosphere.

2. Description of the Related Art

Gas-fueled heating appliances, such as fireplaces, stoves, and fireplace inserts, have the cleanest exhaust of any combustion process and typically include a combustion chamber, or firebox, which is provided with a source of flammable gas. The flammable gas is then combusted to provide heat and aesthetic value to the room in which the appliance is installed. The combustion typically produces carbon monoxide, carbon dioxide, water, oxygen, nitrogen, nitrogen oxide, and carbon soot, which are vented away from the fireplace and to the outside environment through a flue network or chimney. The major constituents are oxygen, nitrogen, carbon dioxide, and water with significantly lower levels of carbon monoxide, nitrogen oxides, and carbon soot. The mercaptan odorant found in gas fuel oxidizes and forms sulfuric oxides. Although such gases are vented to atmosphere, causing no serious problems in the space adjoining the appliance, increasing concerns about the environment may bring this process under heavy scrutiny and eventual regulation.

In certain locations, it is desirable to have an appliance capable of operating without venting to the outside environment. Therefore, gas appliances have been designed which are clean burning but "unvented" in that the gas combusts and the products of the combustion are allowed to enter the room in which the appliance is installed. With such designs, a chimney or flue network is not necessary and consequently such designs can be placed in many locations which would otherwise not be able to accommodate a vented appliance.

Because such designs allow combustion gases to enter the room in which the fireplace is installed, any combustion products, such as carbon monoxide, and airborne particulates, are also exhausted from the appliance directly into the room in which the appliance is located.

In addition, with conventional unvented appliances, the combustion gases rise within the firebox and heat the top wall of the firebox before exiting into the room in which the fireplace is installed. If the heat is not controlled, this can potentially damage the top wall of the firebox or a mantle associated therewith.

U.S. Pat. No. 5,054,468, issued to Moon, discloses an unvented gas-fueled fireplace heater which vents all combustion gases and airborne particulates directly into the room in which the heater is installed, but does not include any means for reducing undesirable emissions.

U.S. Pat. No. 5,139,011, also issued to Moon, discloses an unvented gas-fueled fireplace heater which vents combustion gases and particulates directly to the ambient room air, and further includes a sensor which detects a low oxygen level and a gas supply switch which is activated by the oxygen sensor.

Early attempts at ventless appliances suffer from drawbacks such as: 1) water build-up in the space, 2) acid gases, such as nitrogen oxide and sulfuric oxide, are discharged into the space potentially causing respiratory distress and corrosion in the home, 3) excessive oxygen consumption, and 4) excessive build-up of carbon monoxide levels in the space.

SUMMARY OF THE INVENTION

The present invention is for use in either vented or unvented, gas-fueled, heating appliances and includes a system for reducing the amounts of undesirable combustion products which are released into the atmosphere or space in which the appliance is installed. However, the catalyst of the present invention is particularly useful in unvented applications, where the discharge and treatment of products of combustion is even more critical. The present invention also includes a system for inducing a draft to aspirate the combustion gases from the firebox, and thereby avoid thermal damage to the firebox or mantle.

In particular, the present invention provides a carbon monoxide catalyst element to oxidize the carbon monoxide released by the appliance into carbon dioxide before the combustion gases are vented into the atmosphere or ambient room air. The catalyst element also serves as a filter to screen airborne particulates, such as ceramic fibers dislodged from the synthetic logs disposed within the firebox of a fireplace.

The carbon monoxide catalyst element is disposed within a heating appliance which includes a firebox and a heat exchanger surrounding the firebox. In one embodiment, ambient air enters the heat exchanger through an opening on the bottom front of a fireplace, below the firebox, and is divided such that a portion of the ambient air enters the firebox through openings below gas burners disposed within the firebox, and the remaining portion proceeds through the heat exchanger along a plenum below the firebox, along an adjoining plenum behind the firebox, and then along an adjoining plenum above the firebox. The air within the heat exchanger then merges with combustion air being vented from the firebox, and the recombinant air then exits the fireplace through an opening at the top front of the fireplace.

The front face of the fireplace is enclosed with a glass window to assure complete venting of the combustion gases through the top of the firebox and heat exchanger plenum. The carbon monoxide catalyst element is disposed in the combustion gas exit located at the top of the firebox and the openings at the top and bottom front of the fireplace are covered by a grill, louvers, mesh, or other similar device.

The present invention induces a draft which assists in the aspiration of the combustion gases by drawing the combustion gases from the hot air, high pressure firebox to the cooler air, low-pressure heat exchanger and ambient environment of the room in which the appliance is installed. In addition to the natural draft created by the present design, the appliance can optionally include a blower within the heat exchanger to further assist the aspiration of the combustion gases and increase the thermal output of the appliance.

Moreover, the draft is of a sufficient velocity to aspirate the combustion gases from the firebox at a flowrate sufficiently high to avoid structural damage to the firebox top wall, or an associated mantle.

One advantage of the present invention is that it substantially reduces the amount of carbon monoxide and other gases released by the appliance into the atmosphere or room in which the appliance is installed.

Another advantage of the present invention is that it reduces the number of airborne particulates, such as ceramic fibers, released by the appliance into the room in which the appliance is installed.

Another advantage of the present invention is that the combustion gases are aspirated from the firebox at a rate sufficiently fast to avoid thermal damage to the firebox or an associated mantle.

Another advantage of the present invention is that pollutants from sources present in the space in which the heating appliance is located are destroyed when heated in the combustion chamber and passed through the catalyst.

A still further advantage of the present invention is that it provides an appliance which can be installed into any site regardless of the availability of a chimney or other venting medium.

The present invention, in one form thereof, provides a heating appliance comprising a firebox, a gas burner, a heat exchanger, and a carbon monoxide catalyst element. The firebox includes an outlet and the gas burner which produces products of combustion. The heat exchanger partially surrounds the firebox and a draft results from the firebox being under higher pressure than the heat exchanger. The draft aspirates the products of combustion away from the firebox. The carbon monoxide catalyst element is disposed within the firebox outlet, and oxidizes carbon monoxide contained within the products of combustion into carbon dioxide and prevents airborne particulates from exiting the firebox.

The present invention, in another form thereof, provides a carbon monoxide catalyst element for oxidizing carbon monoxide into carbon dioxide, and comprises a plurality of planar foils, a plurality of corrugated foils, a ceramic oxide coating, and a precious metal coating. The plurality of planar foils and the plurality of corrugated foils are manufactured from stainless steel with the corrugated foils being alternatingly interposed between the planar foils. The ceramic oxide and precious metal coatings are disposed on the plurality of planar foils and the plurality of corrugated foils.

The present invention, in yet another form thereof, provides an unvented, gas-fueled fireplace comprising a firebox, a gas burner, a heat exchanger, and a carbon monoxide catalyst element. The firebox includes an outlet with the gas burners being disposed within the firebox and producing products of combustion. The heat exchanger partially surrounds the firebox and draws ambient air in through an entrance provided below the firebox and exhausts convection heated air through an exit provided above the firebox. A draft results from the firebox being under higher pressure than the heat exchanger, with the draft aspirating the products of combustion away from the firebox and to the ambient environment through the heat exchanger exit. The carbon monoxide catalyst element is disposed within the draft and oxidizes carbon monoxide contained within the products of combustion into carbon dioxide and prevents airborne particulates from exiting the fireplace.

The present invention, in still another form thereof, provides an unvented gas-fueled stove comprising a firebox, a gas burner, a heat exchanger, a combustion gas circuit, and a carbon monoxide catalyst element. The firebox includes an outlet with the gas burner being disposed within the firebox and producing products of combustion. The heat exchanger partially surrounds the firebox and draws ambient air in through an entrance provided below the firebox and exhausts convection heated air through an exit provided above the firebox. The combustion gas circuit includes an inlet communicating ambient air to the firebox and an outlet communicating products of combustion out of the firebox. The carbon monoxide catalyst element is disposed within the combustion gas outlet and oxidizes carbon monoxide contained within the products of combustion into carbon dioxide and prevents airborne particulates from exiting the stove.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrates possible embodiments of the invention and such exemplifications are not to be construed as limiting the scope of the invention in any manner.

DETAILED DESCRIPTION OF THE INVENTION

Figure 1:
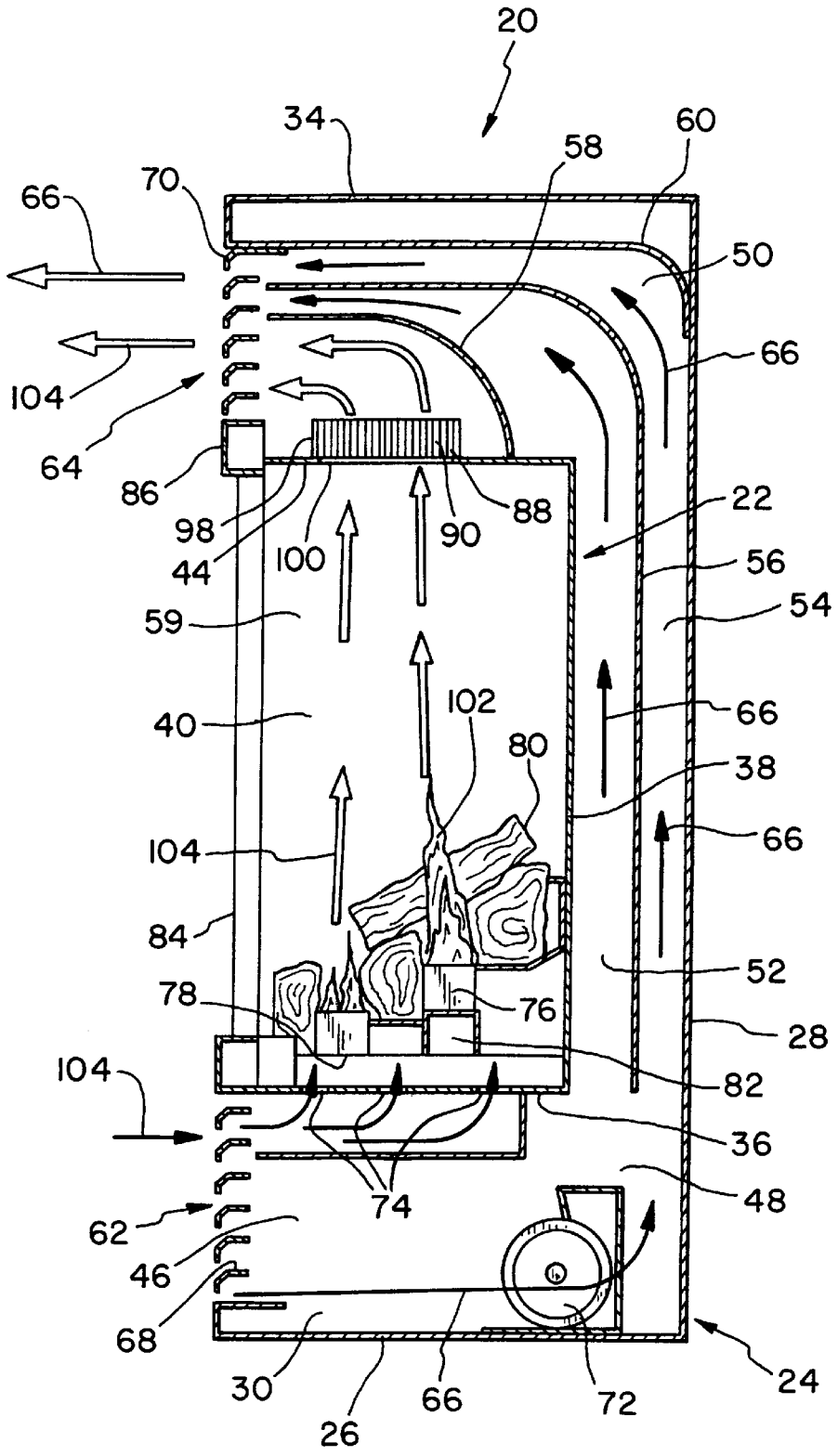
FIG. 1 is a side sectional view of a fireplace incorporating one embodiment of the present invention including the carbon monoxide catalyst element.

Referring now to the drawings and particularly to FIG. 1, the exemplary embodiment is shown as unvented fireplace 20 having firebox 22 partially surrounded by heat exchanger 24.

Fireplace 20 includes bottom wall 26, back wall 28, opposing side walls 30 and 32 (FIG. 2), and top wall 34. Firebox 22 includes bottom wall 36, back wall 38, opposing side walls 40, and top wall 44. Heat exchanger 24 includes bottom plenum 46 disposed between fireplace bottom wall 26 and firebox bottom wall 36, back plenum 48 disposed between fireplace backwall 28 and firebox backwall 38, and top plenum 50 disposed between fireplace top wall 34 and firebox top wall 44.

Back plenum 48 and top plenum 50 are divided into inner passageway 52 and outer passageway 54 by room air deflector 56. Similarly, top plenum 50 is further divided by combustion gas deflector 58, as best shown in FIG. 1, to assist in the aspiration of combustion gases 59 from fireplace 20. Heat shield deflector 60 is disposed above combustion product deflector 58 and room air deflector 56 to prevent the top of fireplace 20, or an associated mantle (not shown), from becoming overheated and potentially damaged.

Bottom plenum 46 is provided with inlet 62, and top plenum 50 is provided with outlet 64 to create a heat exchanger circuit, shown by flowpath arrows 66, which commences with ambient air being drawn in through inlet 62, continuing through back plenum 46 and top plenum 50, and exhausting through outlet 64. In this manner, a cold air draft is induced by introducing relatively cool space temperature air into vent inlet 62 and directing the air flow around the outside of firebox 22. The cold air draft flow 66 exits through vent outlet 64 just above combustion gas flowpath 104, thereby inducing draft which helps aspirate the firebox exhaust along path 104.

Louvered grills 68 and 70 are provided over inlet 62 and outlet 64, respectively, to prevent the passage of relatively large particles and objects. Any combustible products and particles such as lint or dust, which do pass through louvers 68 and into firebox 22 are combusted within firebox 22. To assist in the creation of a draft through heat exchanger 24, fan assembly 72 is provided within bottom plenum 46. In other embodiments, fireplace 20 can be provided without fan assembly 72. Fan 72 does not run continuously, but rather a thermal disk or thermostat is placed in the unit. When the unit reaches a certain temperature, the thermostat makes a switch and fan 72 is energized. When the unit falls below a certain temperature, the thermostat breaks the switch and deenergizes the fan. This operation may be carried out by any one of many known acceptable means to achieve the desired result.

Firebox bottom wall 36 includes a plurality of air inlets 74 which feed air from bottom plenum 46 into firebox 22. In the exemplary embodiment firebox 22 is provided with main burner 76 and front burner 78, although other burner configurations are possible. Burners 76 and 78 are supplied combustible gas via a gas inlet (not shown), and with air through air inlets 74 positioned proximate gas burners 76 and 78 as shown in FIG. 1.

Ceramic logs 80 are also disposed within firebox 22 atop bottom wall 36 to provide an aesthetically pleasing flame and fireplace appearance. Raised grate 82 is provided to give fireplace 20 the appearance of having a larger number of logs than are actually present, and thus reduce manufacturing costs. Glass front 84 substantially seals, in conjunction with sealing elements 86, the front of firebox 22 such that all combustion gases 59 must exit firebox 22 through firebox outlet 88 provided in firebox top wall 44. The average temperature of glass front 84 will be approximately 380° F. with a maximum temperature of the glass of approximately 450° F.

Figure 2:
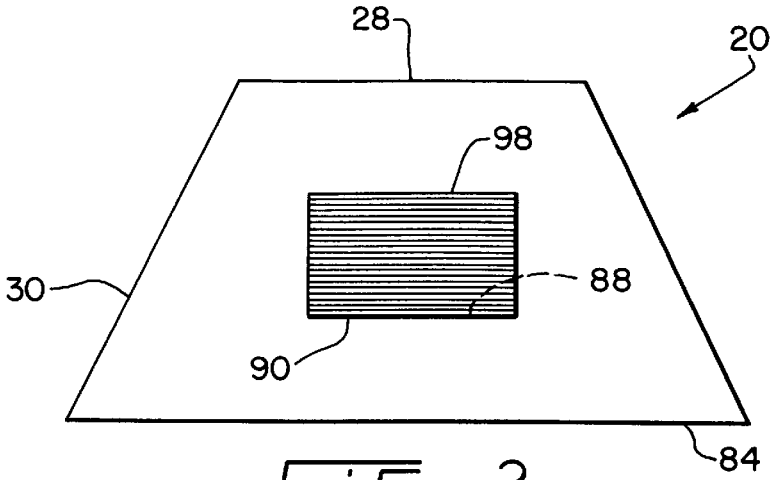
FIG. 2 is top view of the fireplace shown in FIG. 1 showing the placement of the carbon monoxide catalyst element.
Figure 3:
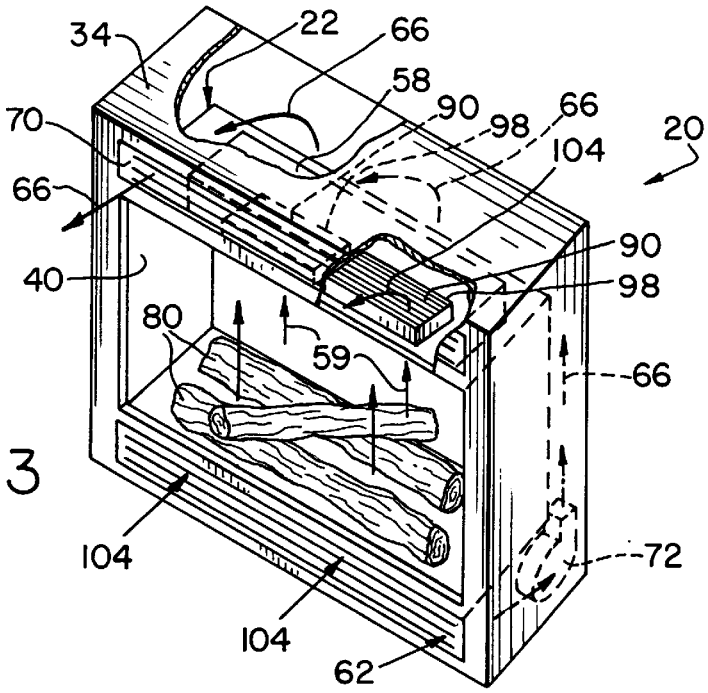
FIG. 3 is right side perspective view of the fireplace shown in FIG. 1.

The combustion of gas at gas burners 76 and 78 produces combustion gases 59 which include, but are not limited to, carbon monoxide. To reduce the amount of carbon monoxide released to the ambient air, fireplace 20 includes carbon monoxide catalyst element 90 which is disposed in, and substantially bridges, firebox outlet 88 as shown in FIGS. 1 and 2. In vented applications, catalyst element 90 may be disposed in the flue or stack or virtually anywhere in the flow path of the products of combustion. Carbon monoxide catalyst element 90 oxidizes the carbon monoxide within combustion gases 59 into carbon dioxide before the gases are released into the ambient environment.

During operation, the firebox operates at a temperature approximately between 300–600° F. Because there is little or no heat generation within catalyst element 90, the catalyst element also operates at approximately the same temperature as the firebox or more accurately the temperature of the firebox at outlet 88. This is in sharp contrast to prior art ceramic converters used in wood burning applications in which large amounts of heat is generated by the combuster or converter. This primarily results from burning off creosote formed during the wood burning process. In the present gas burning application, no creosote is created and therefore no creosote is burned off by the catalyst element.

In prior art wood burning appliances, ceramic honeycomb-type combusters were used because metal was not an acceptable material. Prior art known metals were not acceptable because the metal could not operate under the high temperature conditions associated with burning off creosote. Unlike previously known metals, which had poor oxidation resistance characteristics, the new alloy high temperature stainless steel utilized in the foils of the present invention provides effective oxidation at higher temperatures. The ceramic oxide coating on the stainless steel interacts with the platinum catalyst to convert the carbon monoxide to carbon dioxide. This is in contrast to porcelinized ceramic honeycomb structures used in the wood burning applications. The porcelinized ceramic combusters virtually always crack and are typically held together by an outer skin or by framing with perforations to permit the communication of gas from the firebox through the combuster. A face plate is typically used to prevent the collapse of the porcelinized combuster and to help maintain it in its desired form. It is virtually impossible to remove and clean such a combuster because the ceramic structure is so likely to fall apart. Such problems are absent from the catalyst coated, stainless steel foils of the present invention.

Figure 4A:
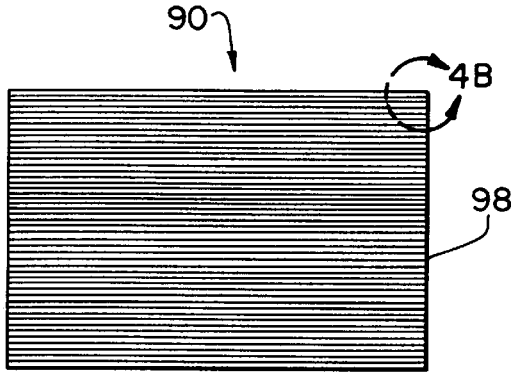
FIG. 4A is top view of the carbon monoxide catalyst element shown in FIG. 3.
Figure 4B:
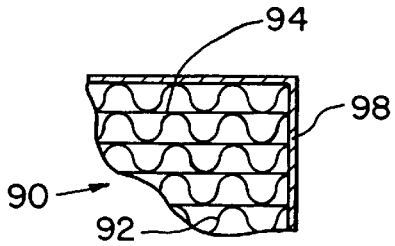
FIG. 4B is a cutaway enlarged top view of the catalyst element of FIG. 4A taken along line 4B.
Figure 5:
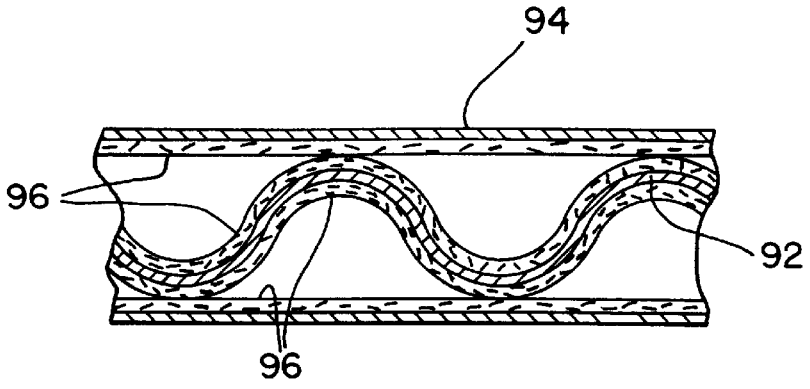
FIG. 5 is an enlarged fragmentary, sectional view of the carbon monoxide catalyst element shown in FIG. 4B which shows alternating individual planar and corrugated, sinusoidal-shaped foils with a catalyst coating disposed thereon.

As best shown in FIGS. 4 and 5, carbon monoxide catalyst element 90, in the exemplary embodiment, is manufactured from a plurality of alternating corrugated stainless steel foils 92 and planar stainless steel foils 94. The stainless steel is a ferritic stainless steel such as Alpha IV, FeCr Alloy, SR-18, or other stainless steels such as 409, 304, or 316. The new stainless steel alloys are acceptable in applications with operating temperatures as high as 1600° F. In the exemplary embodiment, foils 92 and 94 have a thickness of between 0.001 inch and 0.01 inch, preferably 0.002 inch. Foils 92 are corrugated and interposed between planar foils 94 to increase the overall surface area of catalyst element 90 exposed to the combustion gases to thereby increase the oxidizing capabilities of catalyst element 90. The cell density associated with the configuration of the foils is preferably about 20–30 cells per square inch resulting in a porosity of approximately 90% or greater. Combustion in gas burning appliances is especially sensitive to flow obstruction. Very slight pressure drop increases, such as caused by placement of the catalyst element in the exhaust, greatly affects the amount of oxygen present and therefore the amount of carbon monoxide produced.

The primary design criteria in gas burning appliance designs are: 1) maintain aesthetic appearance of flickering flame, 2) provide highest temperature in firebox without compromising the tempered glass front, and 3) providing effective destruction of products of combustion. Optimal flow rate has been found to be approximately 40–60 $ft^3$/minute. The pressure drop across the catalyst element affects all three of the design criteria. The greater the pressure drop the lower the flow rate, resulting in: 1) choking off flame and loss of flickering effect, 2) temperature in firebox perhaps being too great, thereby compromising the tempered glass front, and 3) more effective destruction of products of combustion. The lower the pressure drop and greater the flow rate results in: 1) enhanced flame quality, 2) good operating temperature for glass front, and 3) less effective removal of products of combustion. This would require more catalyst to achieve effective operation resulting in increased unit cost. The advantages and disadvantages must be balanced to arrive at a pressure drop/flow rate relationship that yields the most effective catalyst element configuration.

Ceramic oxide and precious metal coating 96 is disposed on stainless steel foils 92 and 94 as shown in FIG. 5. In the exemplary embodiment, coating 96 is comprised of either aluminum oxide, zirconium oxide, titanium oxide, or a mixture thereof, with the precious metal being platinum or palladium or the like or a mixture thereof. The ceramic oxide coating is applied to the foils in basically two steps. First, an alumina-cerium oxide substance is colloidally dispersed and applied on the foil. Second, platinum, palladium, or a combination of the two metals at submicron levels are highly dispersed and impregnated on the foils at the surface of the ceramic oxide.

Carbon monoxide catalyst element 90 is disposed within catalyst element frame 98. Frame 98 is spot welded, or otherwise attached to firebox top wall 44 in firebox outlet 88. Frame 98 is provided with rim 100 which retains catalyst element 90 within frame 98. The top of frame 98 is open to allow removal of catalyst element 90 for cleaning or replacement. In other embodiments, frame 98 could be provided with a screen (not shown) in lieu of rim 100 to retain catalyst element 90 within frame 98 and enable gases to pass through for oxidation. Carbon monoxide catalyst element 90 also filters out any ceramic fibers released by logs 80 as a result of gas burners 76 and 78 impinging flames 102 upon, and heating, logs 80.

In operation, burners 76 and 78 combust gas drawn in through the gas inlet and create flames 102 within firebox 22. Flames 102 within firebox 22 are fed air through air inlets 74 which allow communication between heat exchanger 24 and firebox 22. Combustion gases 59 rise through firebox 22 and ultimately pass through firebox outlet 88 and carbon monoxide catalyst element 90 along flowpath 104. The carbon monoxide within combustion gases 59 is converted from carbon monoxide to carbon dioxide and is exhausted from fireplace 20 through top plenum 50 and ultimately plenum outlet 64.

Combustion gases 59 are drawn from firebox 22 as a result of the draft created within heat exchanger 24. Combustion gases 59, being heated and under pressure, are naturally drawn toward the relatively cool, low pressure heat exchanger 24 and outside ambient air. The glass cover is fixed in place as by hooks in the top of the frame and screws in the bottom, or by other suitable means. A gasket is used to help seal the firebox. This is necessary to maintain proper flow of the heated gas through the catalyst element 90. If front cover 84 is not fixed, then the path of least resistance would be through the openings between the cover and the frame. The fixed cover also reduces the possibility of lint or other debris from entering the firebox. Because the front of firebox 22 is substantially sealed by glass front 84 and sealing elements 86, combustion gases 59 are forced to exit firebox 22 through firebox outlet 88. Therefore, all combustion gases 59 emanating from burners 76 and 78 pass through carbon monoxide catalyst element 90 and substantially all carbon monoxide is oxidized into carbon dioxide. In addition, any ceramic fibers released by logs 80 are prevented from exiting fireplace 20 by catalyst element 90. In contrast to the ceramic honeycomb-type combusters associated with wood burning applications, which are characterized by a wall thickness of approximately 0.03 inch and a porosity of 50–60 percent, the catalyst element of the present invention is characterized by a porosity of approximately 90 percent or greater. This is primarily due to the significantly reduced wall thickness in the catalyst element of the present invention.

Figure 6:
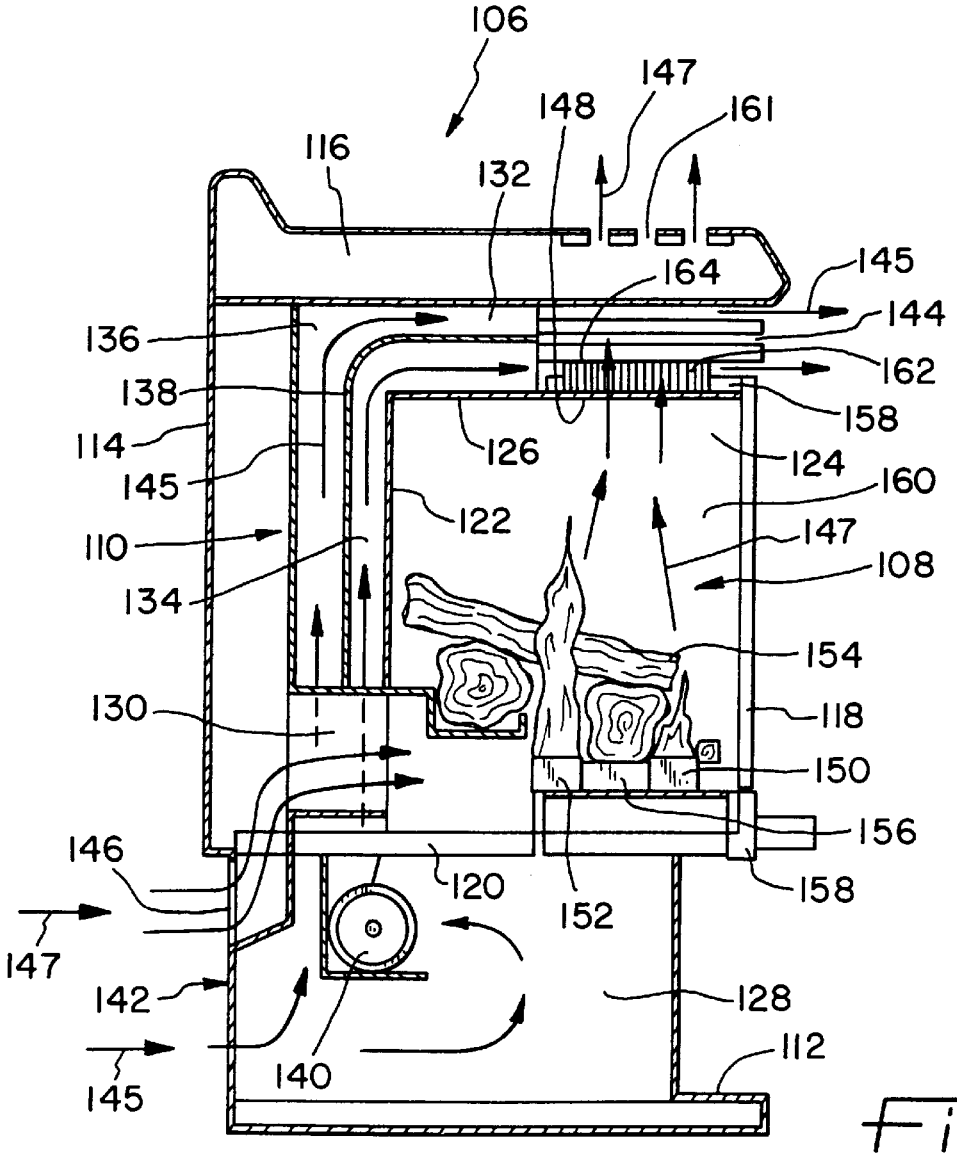
FIG. 6 is a side sectional view of an alternative embodiment of the present invention.

An alternative embodiment of the present invention is shown in FIG. 6 wherein the heating appliance is free standing stove 106. Free standing stove 106 includes base 112, back panel 114, top plate 116, glass front 118, and firebox 108 surrounded by heat exchanger 110. Firebox 108 includes bottom wall 120, back wall 122, opposing side walls 124, and top wall 126. Heat exchanger 110 includes bottom plenum 128 disposed between base 112 and firebox bottom wall 120, back plenum 130 disposed between back panel 114 and firebox back wall 122, and top plenum 132 disposed between firebox top wall 126 and stove top plate 116.

As shown in FIG. 6, back plenum 130 and top plenum 132 are divided into inner passageway 134 and outer passageway 136 by deflection baffle 138. Bottom plenum 128 is optionally provided with blower fan 140 to draw ambient air in through inlet 142, through heat exchanger 110, and out through outlet 144 as indicated by flowpath arrows 145. In the embodiment shown in FIG. 6, inlet 142 is provided on the bottom back side of stove 106, while outlet 144 is provided on the top front side of stove 106.

Firebox 108 is provided with combustion air inlet 146 and firebox outlet 148. In the embodiment shown in FIG. 6, combustion air inlet 146 is provided on the bottom back side of stove 106, while firebox outlet 148 is provided in top wall 126. Outlet 148 leads to stove outlet 161 such that combustion air follows flowpath 147. Firebox 108 also includes front burner 150 and main burner 152 which are supplied gas via a gas conduit (not shown) and with air through combustion air inlet 146. Synthetic logs 154 are provided on raised grate 156 similar to the exemplary embodiment shown in FIG. 1. Glass front 118 substantially seals, in conjunction with sealing elements 158, the front of firebox 108 such that all combustion gases 160 must exit firebox 108 through firebox outlet 148.

Carbon monoxide catalyst element 162, having the same design as the embodiment shown in FIG. 1 is disposed over firebox outlet 148, and is held within frame 164 as described in reference to FIG. 1. Although stove 106 is shown in FIG. 6 having air inlets placed at the bottom back side of stove 106 with air outlets placed on the front and top of stove 106, it is to be understood that the inlets and outlets may be placed in other positions. It is also to be understood that top plate 116 of stove 106 can be utilized as a heating or cooking surface.

Catalyst 90 was tested in two fireplaces of differing designs. The first fireplace included a flue having two concentric ducts with ambient air entering through the outer duct, and hot combustion gases exiting through the inner duct. The catalyst was constructed of two 4"×41"×2" pieces each having 32 cubic inches of volume. The temperature in the firebox was not measured directly, but the catalyst was glowing faintly red indicating a temperature of 500° to 600° C.

The other test fireplace drew ambient air through two holes located on the rear wall of the firebox above the burners. A single catalyst with 42.4 cubic inches of volume was installed in the exhaust flow path approximately 12 inches above the firebox in the exhaust duct. The temperature was measured at approximately 400° F.

Exhaust gases were pulled from the exhaust pipe at a rate of approximately three liters per minute using a diaphragm pump and the exhaust gases were then forced, under pressure, through a refrigerator device designed to separate water from combustion gases with minimum removal of carbon dioxide, nitrogen oxide, and sulphur oxide. The dry gases were then analyzed for water, oxygen, carbon dioxide, carbon monoxide, nitrogen oxide, and sulphur oxide. The gas concentrations were calculated on a wet basis. Flow rates were also monitored to assure placement of the catalyst in the exhaust did not prevent creation of an adequate draft.

Tests were conducted with the fireplaces in three separate modes of The first test was conducted without the catalyst placed in the fireplace. The second test was conducted with the catalyst support frame inserted, and a final test was conducted with the catalyst located within the catalyst support frame. The results of the test of the first fireplace are shown in the following Table #1, and the results of the tests of the second fireplace, are shown in the following Table #2.

TABLE #1

| | Fireplace Empty | Fireplace Bare Support | Fireplace Catalyst |
|---|---|---|---|
| $CH_4$ | 0.57 | 0.57 | 0.57 |
| Combustion Air | 5.35 | 5.35 | 5.35 |
| Supplement Air | 7.18 | 4.78 | 5.15 |
| Total Air | 12.52 | 10.12 | 10.50 |
| Total Flow Rate | 13.09 | 10.69 | 11.07 |
| $CO_2$ | 4.31% | 5.27% | 5.09% |
| $H_2O$ | 9.57% | 11.48% | 11.13% |
| $O_2$ | 11.35% | 9.24% | 9.63% |
| $N_2$ | 74.79% | 74.01% | 74.15% |
| CO, ppm | 36 | 57 | 3 |
| $NO_2$, ppm | 37 | 35 | 34 |
| NO, ppm | 22 | 12 | 25 |

TABLE #2

| | Fireplace Blank | Fireplace Support | Fireplace Catalyst |
|---|---|---|---|
| $CH_4$ | 0.43 | 0.43 | 0.43 |
| Combustion Air | 4.09 | 4.09 | 4.09 |
| Supplement Air | 10.40 | 9.45 | 10.32 |
| Total Air | 14.49 | 13.54 | 14.41 |
| Total Flow Rate | 14.92 | 13.97 | 14.84 |
| $CO_2$ | 2.89% | 3.09% | 2.91% |

TABLE #2-continued

| | Fireplace Blank | Fireplace Support | Fireplace Catalyst |
|---|---|---|---|
| $H_2O$ | 6.76% | 7.15% | 6.79% |
| $O_2$ | 14.44% | 14.02% | 14.41% |
| $N_2$ | 75.90% | 75.75% | 75.89% |
| CO, ppm | 15 | 18 | 1 |
| $NO_2$, ppm | 21 | 21 | 22 |
| NO, ppm | 13 | 13 | 19 |

As shown in Table #1, when the bare catalyst support frame was inserted in the fireplace exhaust, the air draft was effectively choked off with a corresponding increase in carbon dioxide concentration from 4.31 percent to 5.27 percent. The carbon monoxide concentration increased from 37 parts per million to 57 parts per million.

However, when the catalyst was placed into the support frame, the air draft flow rate was relatively unchanged, but the carbon monoxide levels were dramatically reduced from 57 parts per million to 3 parts per million. This represents a 91.8 percent reduction in carbon monoxide emission.

As shown in Table #2, without a catalyst the carbon monoxide concentration was 15 to 18 parts per million. However, when the catalyst was inserted, the flow rate was approximately the same as for the empty fireplace, but the carbon monoxide levels were dramatically reduced to approximately one part per million.

Referring now to FIGS. 7A–7E, corrugated foil members 200 and planar foil elements 202 are alternatingly placed in catalyst element frame 204. The foil members are sized so as to friction fit along sidewalls 206 and 208 of frame 204 during assembly. Inwardly projecting flanges 210 and 212 are provided at the base of frame of 204 to engage the outermost bottom portions of foil members 200 and 202 so as to prevent excessive downward axial movement by the foil members and to thereby hold them in place within frame 204. An upper lip may be provided along the upper edge of frame 204 to prevent upward axial movement of foil members 200 and 202 once placed in frame 204. At the bottom of frame 204 and along the lengths of front and back walls 214 and 216, respectively, flanges 218 and 220 extend outwardly and engage the inside surface of ceiling 222 along the perimeter of catalyst element receiving apertures 224 and 226 (see FIG. 8A). Catalyst 234 is attached to firebox 236 at mounting apertures 228 by mounting screws 230 as shown in FIGS. 8A–8C, discussed in detail below.

Figure 7A:
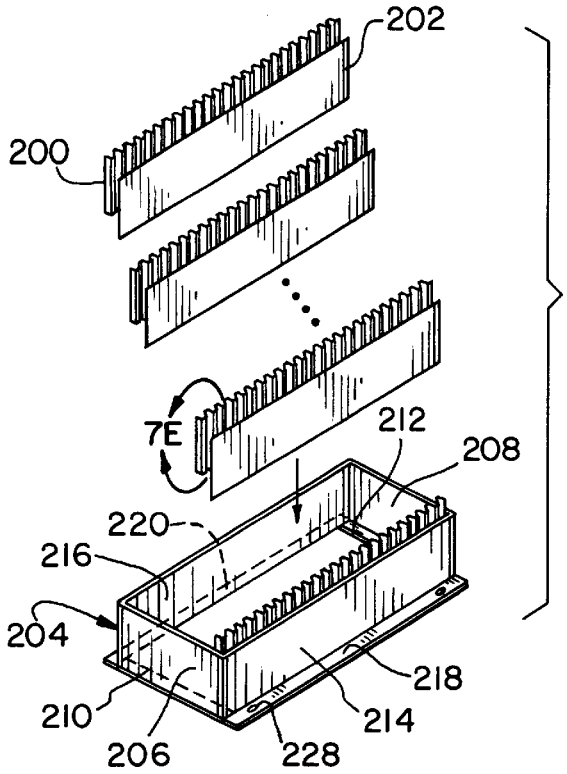
FIG. 7A is a perspective view of the carbon monoxide catalyst element being assembled.
Figure 7E:
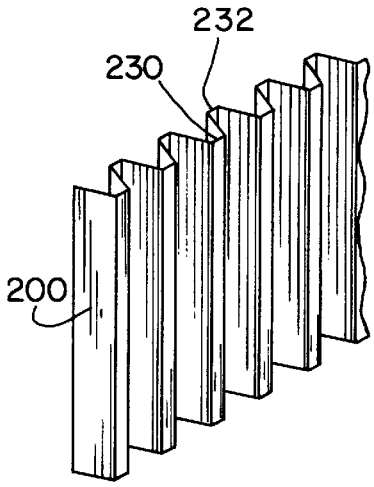
FIG. 7E is a perspective view of the corrugated foil member of FIG. 7A taken along lines 7E.
Figure 7B:
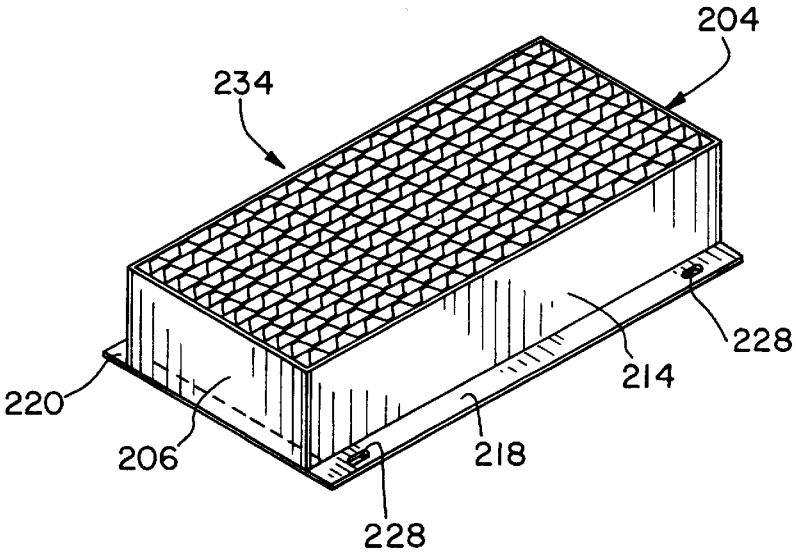
FIG. 7B is a perspective view of the carbon monoxide catalyst element of FIG. 7A in a final assembled state.
Figure 7C:
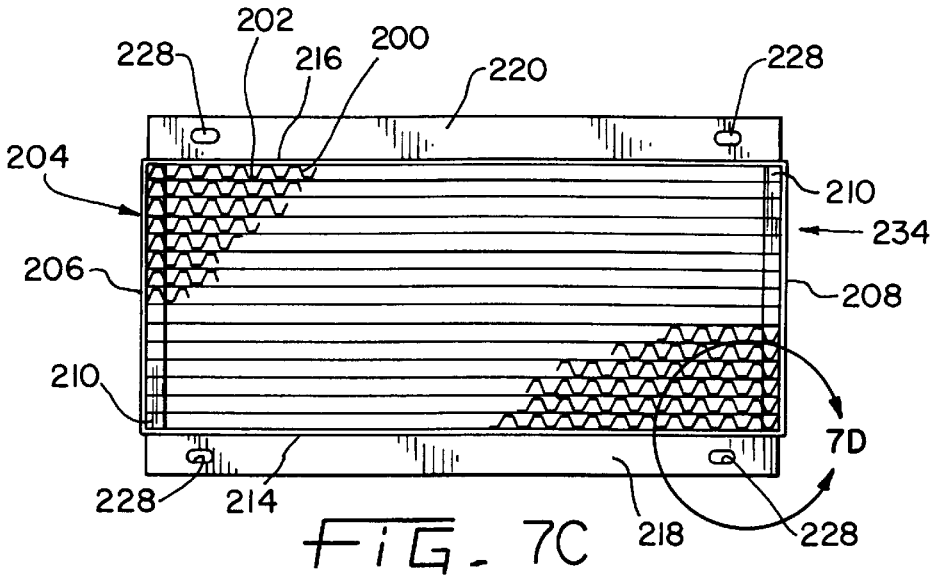
FIG. 7C is a top view of the carbon monoxide catalyst element of FIG. 7B.
Figure 7D:
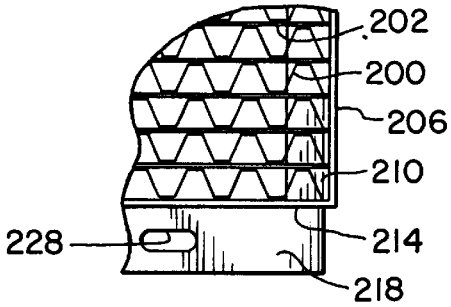
FIG. 7D is an enlarged, top view of the carbon monoxide catalyst element of FIG. 7C taken along lines 7D.

As opposed to sinusoidal-shaped corrugated member 92, of FIG. 5, corrugated foil member 200, as best shown in FIG. 7E, is semi-hexagonal along oppositely faced turns 230 and 232. The corrugated foil members may be shaped in a variety of configurations, such as sinusoidal, hexagonal, triangular, square, etc. When selecting a shape for the corrugated foil member, the important consideration is that when coating the foil member with ceramic oxide, coating tends to build up along sharp angles in the foil. The triangular shape may be most efficient and economical because less overlapping of metal occurs and less catalyst coating is required. Planar foils 202 may be removed altogether when using corrugating foil members that are shaped so as to engage one another in a spaced apart relationship when disposed in frame 204. An acceptable range of wall thickness for the foils, both corrugated and planar, is preferably between 0.001 and 0.01 inch with a preferred thickness of 0.002 inch. The final completed assembly of carbon monoxide catalyst element 234 is shown in FIGS. 7B and 7C.

Figure 8A:
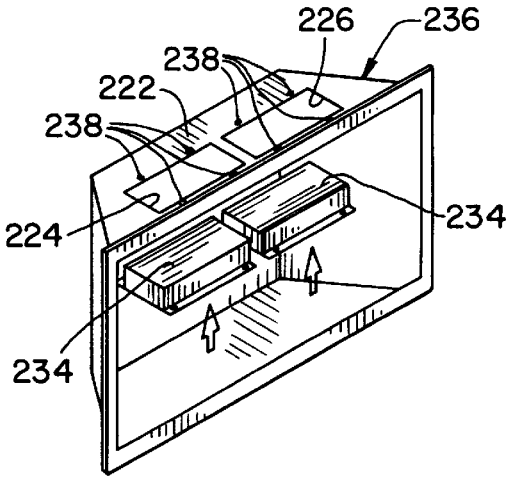
FIG. 8A is a left front perspective view of the fireplace of FIG. 1 with an alternative carbon monoxide catalyst element arrangement showing a method of assembly.
Figure 8B:
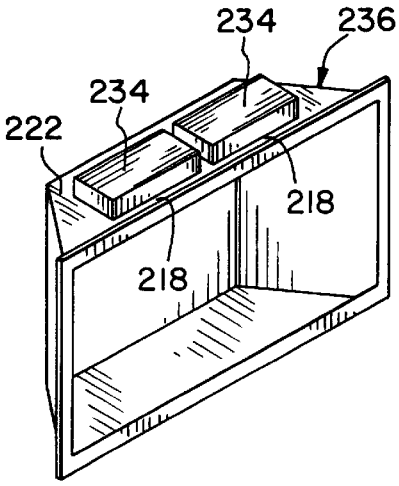
FIG. 8B illustrates the fireplace of FIG. 8A with the carbon monoxide catalyst element fully assembled.
Figure 8C:
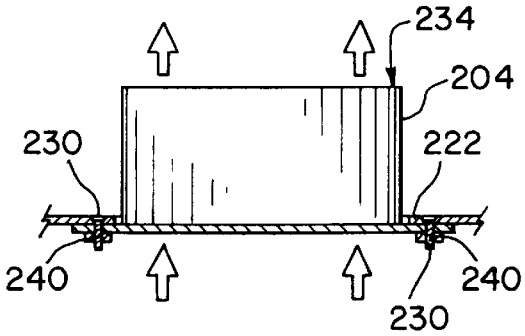
FIG. 8C is a side sectional view of the carbon monoxide catalyst element of FIG. 8B taken along lines 8C.

FIGS. 8A–8C illustrate an alternative embodiment of the present invention in which a pair of catalyst elements 234 are mounted to the firebox, as opposed to the single catalyst element of FIG. 1. FIGS. 8A–8C illustrate the method of assembling completed catalyst element 234 onto firebox 236 by inserting the catalysts into receiving apertures 224 and 226 provided in ceiling 222 of firebox 236. From within the firebox, the catalyst elements are disposed axially upward into and through the apertures until support flanges 218 and 220 engage the inside surface of ceiling 222. Mounting apertures 228 are aligned with mounting holes 238 formed in ceiling 22 adjacent apertures 224 and 226. Mounting bolts 230, or any other suitable fastening device or means, are received into and through apertures 228 and holes 238 and rotatably engage nuts 240 to secure catalyst elements 234 to ceiling 222 of firebox 236.

The base of frame 204 is essentially hollow so that gases may flow from within firebox 236 through apertures 224 and 226 through frame aperture 204 and over foils 200 and 202 of catalyst element 234 as shown in FIG. 8C. Catalyst elements 234 may be cleaned by detaching bolts 230 from nuts 240 and removing the catalyst element from the firebox. Once removed, the catalyst element may be cleaned by immersing the entire catalyst element, frame, and foils, in a cleaning solution such as sodium bicarbonate or vinegar. It is preferred not to remove the individual foils once catalization has occurred. The cell density is approximately 20–30 cells per square inch in completed catalyst element 234. Catalyst element 234 generally operates at a temperature approximately equal to the temperature in firebox 236, typically between 300 and 600° F., because there is little or no heat generation within the converter. This is in sharp contrast to ceramic converters used in wood burning applications in which substantial heat is generated by the converter, thereby resulting in a much elevated converter operating temperature. In woodburning applications, creosote is produced and is burned off in the ceramic converters resulting in a significant increase in the operating temperature of the ceramic converter. By contrast, the gas burning applications associated with the present invention does not result in the creation of creosote. Catalyst element 234 does burn carbon monoxide in converting it to carbon dioxide. The catalyst also oxides some methane, formaldehyde, given off from insulation or carpets or out gases, from sources such as paint, polish remover, or other household objects. The catalyst burns CO to $CO_2$ and also some of the methane uncombusted by the burner. The catalyst also burns formaldehyde and other volatile organic compounds that may be present in the combustion air. Such volatile organic compounds come from paint, polish remover, or other household objects.

Figure 9:
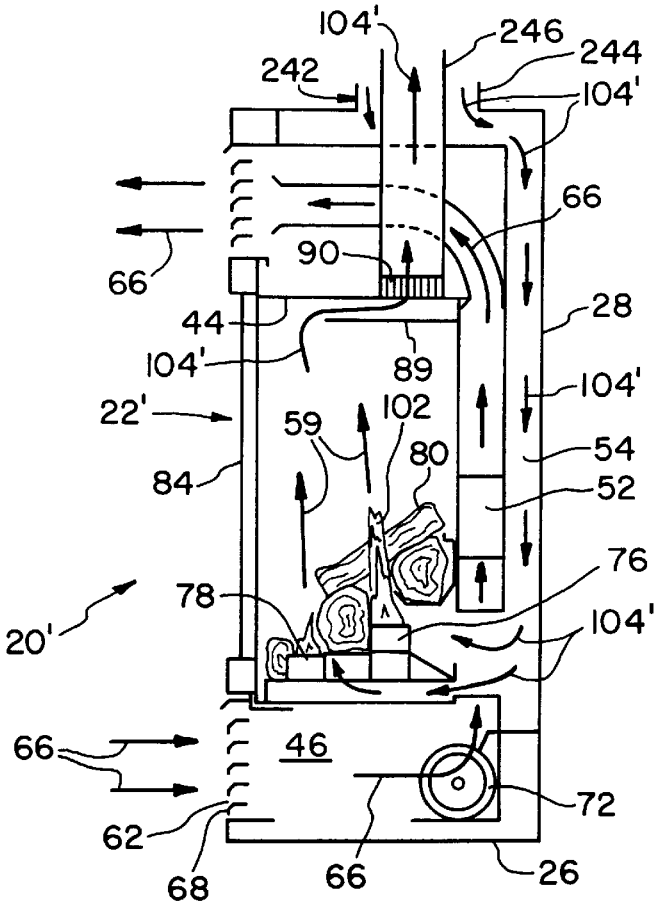
FIG. 9 is a partial side sectional view of a vertically vented fireplace incorporating the present invention including the carbon monoxide catalyst element.
Figure 10:
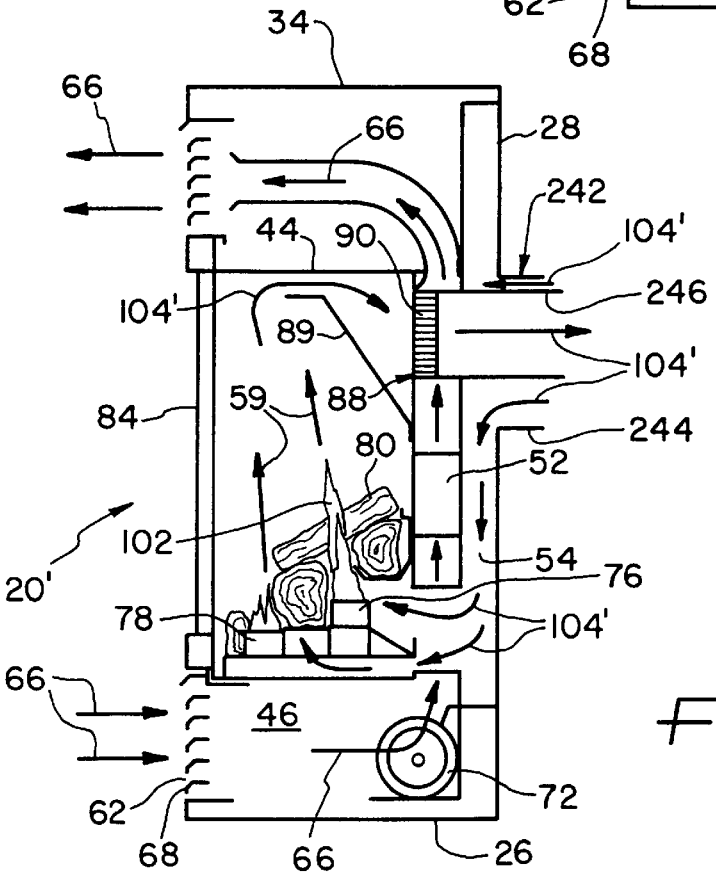
FIG. 10 is a partial side sectional view of a horizontally vented fireplace incorporating the present invention including the carbon monoxide catalyst element.

FIG. 9 illustrates the catalytic converter of the present invention in a vented type appliance, an example of a prior art vented appliance in which the present invention may be incorporated is illustrated in U.S. Pat. No. 5,320,086 (Beal), which is hereby incorporated into this document by reference and which is assigned to the assignee of the present invention. As shown in FIGS. 9 and 10, a concentric flue pipe assembly 242 includes a fresh air pipe 244 and exhaust pipe 246.

During operation, air flow through direct vent gas fireplace 20' is as follows: combustion air flows through the annular space defined between fresh air pipe 244 and exhaust pipe 246 from the ambient environment outside the building in which direct vent gas fireplace 20' is installed. The combustion air flows through an air intake duct and combustion air duct 54 into the combustion chamber formed within firebox 22'. The flow of combustion air into the combustion chamber is represented by air flow directional arrows 104'. Combustion products produced in firebox 22' flow through the opening defined between baffle plate 89 and firebox top wall 44, pass over catalyst 90, through the lower portion of exhaust pipe 246, and are exhausted to the outside environment through the outermost portion of exhaust pipe 246. The operation of the catalyst unit is as described hereinabove. In this manner, the expulsion of products of combustion into the atmosphere is essentially eliminated. As illustrated in FIGS. 9 and 10, respectively, the vent flue arrangement may be vertical or horizontal. The vented application does not have to be a concentric intake/exhaust configuration and may take any conventional form.

While the present invention has been described as having an exemplary design, the present invention can be further modified within the spirit and scope of this disclosure. Although the present invention has been described as being particularly useful in unvented applications, the present invention is nonetheless useful in vented applications as well. This application is therefore intended to encompass any variations, uses, or adaptations of the invention using its general principles. Further, this application is intended to encompass such departures from the present disclosure as come within known or customary practice in the art to which this invention pertains, and which fall within the limits of the appended claims.

What is claimed is:

1. A heating appliance, comprising:

a firebox having an outlet in communication with a space containing ambient air and within which said appliance is located;

a gas burner disposed within said firebox, said gas burner providing a flame and heat source, said flame producing products of combustion, the products of combustion exiting said firebox through said firebox outlet;

a catalyst element in communication with said firebox outlet and through which a portion of the products of combustion flow, wherein at least some of the through-flowing products of combustion are catalyzed, the catalyzed products of combustion directed into the space in which said appliance is located, carbon monoxide contained within said products of combustion oxidized by said catalyst element into carbon dioxide; and means forming a plenum in fluid communication with the space within which said appliance is located and through which ambient air is conveyed through said appliance, said plenum at least partially surrounding said fire box and having an inlet into which ambient air from the space within which said appliance is located is received, and an outlet which is open to the space within which said appliance is located, the ambient air having been conveyed through said appliance discharged through said plenum outlet into the space in which said appliance is located;

wherein the ambient air conveyed through said plenum and the products of combustion are substantially out of fluid communication with each other within said appliance.

2. The heating appliance of claim 1, wherein said appliance is a fireplace having a transparent front face.

3. The heating appliance of claim 1, wherein said appliance is a stove.

4. The heating appliance of claim 1, wherein said appliance is a fireplace insert.

5. The heating appliance of claim 1, wherein said catalyst element includes a plurality of planar foils, a plurality of corrugated foils alternatingly interposed between said planar foils, and a ceramic oxide and precious metal coating disposed on said planar foils and said corrugated foils.

6. The heating appliance of claim 5, wherein said planar foils and said corrugated foils are manufactured from stainless steel chosen from the group of ferritic stainless steels consisting of Alpha IV, FeCrAlloy, 409, 304, and 316, said ceramic oxide is chosen from the group consisting of aluminum oxide, zirconium oxide, and titanium oxide, and said precious metal is chosen from the group consisting of platinum and palladium.

7. The heating appliance of claim 1, wherein said carbon monoxide catalyst is disposed within a frame secured to said firebox outlet, said frame adapted to allow removal of said carbon monoxide catalyst for cleaning and replacement.

8. A gas-fueled stove, comprising:

a firebox having an outlet in communication with a space in which said stove is located;

a gas burner disposed within said firebox, said gas burner providing a flame and heat source, said flame producing products of combustion, said products of combustion exiting said firebox through said firebox outlet;

a catalyst element in communication with said firebox outlet and through which a portion of the products of combustion flow, wherein at least some of the through-flowing products of combustion are catalyzed, the catalyzed products of combustion directed into the space in which said stove is located, carbon monoxide contained within said products of combustion oxidized by said catalyst element into carbon dioxide, the catalyzed products of combustion flowing from said catalyst element and to the space in which said stove is located along a first flowpath;

a heat exchanger partially surrounding said firebox, said heat exchanger having an inlet into which air from the space in which said stove is located is received, said heat exchanger inlet provided below said firebox, said heat exchanger having an outlet provided above said firebox through which heated air flows to the space in which said stove is located along a second flowpath, said first and second flowpaths being different flowpaths.

9. The stove of claim 8, wherein said catalyst element includes a plurality of planar foils, a plurality of corrugated foils alternatingly interposed between said planar foils, and a ceramic oxide and precious metal coating disposed on said planar foils and said corrugated foils.

10. The stove of claim 9, wherein said planar foils and said corrugated foils are manufactured from stainless steel chosen from the group of ferritic stainless steels consisting of Alpha IV, FeCr alloy, 409, 304, and 316, said ceramic oxide is chosen from the group consisting of aluminum oxide, zirconium oxide and titanium oxide, and said precious metals chosen from the group consisting of platinum and palladium.

11. The stove of claim 8, wherein said stove has a front, a back and a top, said heat exchanger inlet provided on said back of said stove, said heat exchanger outlet provided on said front of said stove, and further comprising a combustion gas circuit including an inlet communicating air from the space in which said stove is located to said firebox and an outlet communicating products of combustion from said catalyst element to the space in which said stove is located, said combustion gas circuit inlet provided on said back of said stove, said combustion gas circuit outlet provided on said top of said stove.

12. The stove of claim 11, wherein said heat exchanger outlet, and said combustion gas circuit outlet further include a louvered grill.

13. The stove of claim 8, wherein said heat exchanger includes a blower, air from the space in which said stove is located at least partially induced through said heat exchanger by said blower.

14. The stove of claim 8, wherein said catalyst element is removably disposed within a frame, a removed said catalyst element replaceable within said frame.

15. An unvented heating appliance located at least partially in a room and comprising:

a gas burner providing a flame and disposed within a firebox, said flame producing products of combustion, said firebox having an outlet through which the products of combustion exit said firebox;

a carbon monoxide catalyst element in communication with said firebox outlet, carbon monoxide contained in the products of combustion oxidized in said catalyst element, the catalyzed products of combustion directed into the room; and a heat exchanger partially surrounding said firebox and having an inlet, an outlet and a plenum defining a heat exchanger airstream circuit between said heat exchanger inlet and outlet, said heat exchanger inlet located below and spaced from said heat exchanger outlet and receiving room air into said plenum, said heat exchanger outlet exhausting room air heated by said heat exchanger into the room, the heated room air and products of combustion substantially out of fluid communication with each other within said appliance;

wherein the products of combustion are aspirated from said appliance by the heated room air exhausted into the room from said heat exchanger outlet.

16. The heating appliance of claim 15, wherein said appliance is a fireplace.

17. The heating appliance of claim 16, wherein said fireplace has a substantially sealed transparent front face.

18. The heating appliance of claim 15, wherein said appliance is a stove.

19. The heating appliance of claim 15, wherein said appliance is a fireplace insert.

20. The heating appliance of claim 15, wherein said carbon monoxide catalyst element includes a plurality of planar foils, a plurality of corrugated foils alternatingly interposed between said planar foils, and a ceramic oxide and precious metal coating disposed on said planar foils and said corrugated foils.

21. The heating appliance of claim 20, wherein said planar foils and said corrugated foils are manufactured from stainless steel chosen from the group of ferritic stainless steels consisting of Alpha IV, FeCr Alloy, 409, 304, and 316, said ceramic oxide is chosen from the group consisting of aluminum oxide, zirconium oxide, and titanium oxide, and said precious metal is chosen from the group consisting of platinum and palladium.

22. The heating appliance of claim 15, wherein said heat exchanger includes a blower, air from the room in which said appliance is located at least partially induced through said heat exchanger by said blower.

23. The heating appliance of claim 15, wherein said carbon monoxide catalyst element is disposed within a frame secured to said firebox outlet, said frame adapted to allow removal of said carbon monoxide catalyst element for cleaning and replacement.

24. A heating appliance, comprising:

a firebox defined by a plurality of walls and having an outlet located in one of said walls, said firebox in fluid communication with a space containing ambient air and within which said appliance is located;

a gas burner disposed within said firebox, said gas burner providing a flame and heat source, said flame producing products of combustion, said firebox outlet providing the sole exit from said firebox for the products of combustion;

a catalyst element in communication with said firebox outlet and through which a portion of the products of combustion flow, wherein at least some of the through-flowing products of combustion are catalyzed, the catalyzed products of combustion directed into the space in which said appliance is located, carbon monoxide contained within said products of combustion oxidized by said catalyst element into carbon dioxide; and a plenum having an inner passageway and an outer passageway, said inner and outer passageways at least partially surrounding said firebox, said plenum inner passageway located between said firebox and said outer passageway, said plenum having an inlet in fluid communication with the space within which said appliance is located and through which ambient air is conveyed to said inner and outer passageways, said inner and outer passageways respectively having outlets which are open to the space within which said appliance is located, the ambient air having been conveyed through said appliance discharged through said inner and outer passageway outlets into the space in which said appliance is located;

wherein the products of combustion and the ambient air conveyed through said inner and outer passageways are substantially out of fluid communication with each other within said appliance.

25. The appliance of claim 24, wherein one of said walls comprises a transparent panel through which the interior of said firebox is visible from the space in which said appliance is located.

26. The appliance of claim 24, wherein the ambient air being conveyed through said plenum inner passageway and the ambient air being conveyed through said plenum outer passageway are substantially out of fluid communication which each other within said appliance.

27. The appliance of claim 24, further comprising a combustion gas deflector, said plenum inner passageway defined in part by said combustion gas deflector, and wherein the products of combustion and the ambient air conveyed through said inner passageway are separated from each other within said appliance by said combustion gas deflector.

28. The appliance of claim 24, further comprising a room air deflector, said plenum inner and outer passageways defined in part by said room air deflector.

29. The appliance of claim 31, wherein said plenum inner and outer passageways are separated by said room air deflector.

30. A fireplace, comprising:

a firebox defined by a plurality of walls and having an outlet located in one of said walls, said firebox in fluid communication with a space containing ambient air and within which said fireplace is located;

a gas burner disposed within said firebox, said gas burner providing a flame and heat source, said flame producing products of combustion, said firebox outlet providing the sole exit from said firebox for the products of combustion;

a catalyst element in communication with said firebox outlet and through which a portion of the products of combustion flow, wherein at least some of the through-flowing products of combustion are catalyzed, the catalyzed products of combustion directed into the space in which said fireplace is located, carbon monoxide contained within said products of combustion oxidized by said catalyst element into carbon dioxide; and a plenum having an inner passageway and an outer passageway, said inner and outer passageways at least partially surrounding said firebox, said plenum inner passageway located between said firebox and said outer passageway, said plenum having an inlet in fluid communication with the space within which said fireplace is located and through which ambient air is conveyed to said inner and outer passageways, said inner and outer passageways respectively having outlets which are open to the space within which said fireplace is located, the ambient air having been conveyed through said fireplace discharged through said inner and outer passageway outlets into the space in which said fireplace is located;

wherein the products of combustion and the ambient air conveyed through said inner and outer passageways are substantially out of fluid communication with each other within said fireplace.

31. The fireplace of claim 30, wherein one of said walls comprises a transparent panel through which the interior of said firebox is visible from the space in which said fireplace is located.

32. The fireplace of claim 30, wherein the ambient air being conveyed through said plenum inner passageway and the ambient air being conveyed through said plenum outer passageway are substantially out of fluid communication which each other within said fireplace.

33. The fireplace of claim 30, further comprising a combustion gas deflector, said plenum inner passageway defined in part by said combustion gas deflector, and wherein the products of combustion and the ambient air conveyed through said inner passageway are separated from each other within said fireplace by said combustion gas deflector.

34. The fireplace of claim 30, further comprising a room air deflector, said plenum inner and outer passageways defined in part by said room air deflector.

35. The fireplace of claim 34, wherein said plenum inner and outer passageways are separated by said room air deflector.

* * * * *